US011278754B2

(12) United States Patent
Kempf et al.

(10) Patent No.: US 11,278,754 B2
(45) Date of Patent: Mar. 22, 2022

(54) DRY ALARM VALVE STATION AND FIRE-EXTINGUISHING FACILITY COMPRISING SAME

(71) Applicant: Minimax GmbH, Bad Oldesloe (DE)

(72) Inventors: Peter Kempf, Bad Oldesloe (DE); Frank Stachowitz, Ratzeburg (DE)

(73) Assignee: Minimax GmbH, Bad Oldesloe (DE)

( * ) Notice: Subject to any disclaimer, the term of this patent is extended or adjusted under 35 U.S.C. 154(b) by 155 days.

(21) Appl. No.: 16/650,855

(22) PCT Filed: Sep. 19, 2018

(86) PCT No.: PCT/EP2018/075296
§ 371 (c)(1),
(2) Date: Mar. 25, 2020

(87) PCT Pub. No.: WO2019/063373
PCT Pub. Date: Apr. 4, 2019

(65) Prior Publication Data

US 2020/0282248 A1 Sep. 10, 2020

(30) Foreign Application Priority Data

Sep. 28, 2017 (DE) ..... 10 2017 122 651.6

(51) Int. Cl.
*A62C 35/68* (2006.01)
*A62C 35/62* (2006.01)
(Continued)

(52) U.S. Cl.
CPC ..... *A62C 35/68* (2013.01); *A62C 35/62* (2013.01); *A62C 35/645* (2013.01); *G08B 17/04* (2013.01)

(58) Field of Classification Search
CPC ..... A62C 35/62; A62C 35/645; A62C 35/68; G08B 17/04
See application file for complete search history.

(56) References Cited

U.S. PATENT DOCUMENTS 1,869,202 A * 7/1932 Lowe ..... A62C 35/645 169/17
6,158,520 A * 12/2000 Reilly ..... A62C 35/62 169/17
(Continued)

FOREIGN PATENT DOCUMENTS

DE 20 2010 016 720 U1 5/2011
DE 10 2010 033 178 B3 1/2012
(Continued)

OTHER PUBLICATIONS

International Search Report (with English translation), International Application No. PCT/EP2018/075296 (published under WO 2019063373), 5 pages (Jan. 22, 2019).

*Primary Examiner* — Darren W Gorman
(74) *Attorney, Agent, or Firm* — Perkins Coie LLP

(57) ABSTRACT

The invention concerns a dry alarm valve station of a fire extinguishing installation. According to the invention it is proposed that the dry alarm valve station includes an alarm valve, an alarm line connected to the alarm valve, an alarm alert device, preferably with an alarm pressure switch, which is connected to the alarm line and is configured to trigger an alarm signal when there is a predetermined fluid pressure in the alarm line, and a pressure-operated valve which is interposed between the alarm alert device and the alarm valve, is controlled by a control chamber, and is configured to block the alarm line as long as there is the predetermined control pressure in the control chamber and to open it when the pressure falls below the predetermined control pressure in the control chamber.

20 Claims, 6 Drawing Sheets

(51) Int. Cl.
*A62C 35/64* (2006.01)
*G08B 17/04* (2006.01)

(56) References Cited

U.S. PATENT DOCUMENTS

| | | | | |
|---|---|---|---|---|
| 9,492,696 | B2 * | 11/2016 | Ringer | F16K 31/1221 |
| 2013/0098641 | A1 | 4/2013 | Capsius | |
| 2018/0264302 | A1 * | 9/2018 | Pohl | A62C 37/44 |

FOREIGN PATENT DOCUMENTS

| | | | |
|---|---|---|---|
| DE | 10 2016 211 240 | A1 | 12/2017 |
| WO | WO 2012/112808 | A2 | 8/2012 |
| WO | WO 2016/179406 | A1 | 11/2016 |

* cited by examiner

DRY ALARM VALVE STATION AND FIRE-EXTINGUISHING FACILITY COMPRISING SAME

PRIORITY CLAIM AND INCORPORATION BY REFERENCE

This application is a 35 U.S.C. § 371 application of International Application No. PCT/EP2018/075296, filed Sep. 19, 2018, which claims the benefit of German Application No. 10 2017 122 651.6 filed Sep. 28, 2017, each of which is incorporated by reference in its entirety.

TECHNICAL FIELD

The present invention concerns a dry alarm valve station for a fire extinguishing installation. The invention further concerns a fire extinguishing installation having a dry alarm valve station.

BACKGROUND AND SUMMARY OF THE INVENTION

Dry alarm valve stations, also referred to as DAV stations, are generally known. They are required in fire extinguishing installations having dry pipe networks in order in a standby mode to reliably separate from the dry pipe network, the extinguishing fluid which is available on the part of the supply line, as long as there is no fire situation, but must then be capable of conveying extinguishing fluid reliably and in a short time scale through the dry pipe network and the sprinklers provided therein so that it is possible to efficiently fight a fire which occurs.

In the above-indicated standby mode there is usually provided downstream of the dry alarm valve station a sprinkler line arrangement which is typically distributed in network-like fashion in a building in order to be able to supply extinguishing fluid to sprinklers distributed in one or more rooms over small or large areas. The sprinklers in their standby mode are usually gas-tightly closed and are opened in a fire situation, for example after triggering of a thermally active element. Air which is usually under pressure is introduced into the dry pipe networks in the state of the art. After opening of at least one sprinkler the pressurized gas issues from the sprinkler whereby there is a pressure drop in the sprinkler line arrangement. That event in known fashion leads to opening of the dry alarm valve station and consequently also an alarm alert. To implement the alarm alert function known dry alarm valve stations usually have an alarm line which extends from an alarm valve in the direction of an alarm device which for example can have a pressure switch and/or an alarm bell. The alarm means is usually configured in dependence on pressure, that is to say when a predetermined threshold value is reached or exceeded in the alarm line, to trigger an alarm, wherein the alarm line is connected to the alarm valve in such a way that it is deluged upon a transition on the part of the alarm valve from a blocking state into the release state. So that an alarm can be triggered the gas which is in the alarm line and which is under ambient pressure or possibly under an increased pressure firstly has to escape.

The dry alarm valve stations and fire extinguishing installations known in the state of the art generally operate satisfactorily in regard to their reliability.

As both an alarm alert and also extinguishing agent discharge from the sprinklers can only occur, by virtue of the principle involved, when the respective line which is dry in the standby mode, being therefore the sprinkler line or the alarm line, is freed of the air which is to be found therein in the standby mode and is completely deluged the known systems involve a time delay in regard to the extinguishing agent discharge and in regard to the alarm alert. The time delay becomes correspondingly greater, the more air that there is to be found in the systems, that is to say the delay becomes greater, the larger the systems become, and that limits the use of a dry alarm valve station to a given size of building or area.

The object of the invention was to overcome the above-indicated disadvantages as extensively as possible. In particular the object of the invention was to provide a dry alarm valve station which permits a reduction in the amount of air in the system, in particular the amount of pressurized air, without compromising the reliability of the installation. At any event the object of the invention was to provide an alternative dry alarm valve station and an alternative fire extinguishing installation having such a dry alarm valve station.

The object of the invention is attained by proposing a dry alarm valve station. The dry alarm valve station has an alarm valve which can be connected at the inlet side to an extinguishing fluid-filled supply line and at the outlet side to a sprinkler line which is air-filled in a standby state of the fire extinguishing installation and a pressure-operated valve body which is controlled by means of a control chamber and which is configured in a blocking state to separate the supply line from the sprinkler line as long as there is a predetermined control pressure in the control chamber and to connect the supply line to the sprinkler line in a an open release state. The dry alarm valve station further comprises an alarm line connected to the alarm valve in such a way that the alarm line is deluged with extinguishing fluid when the alarm valve assumes the release state, and an alarm device, preferably with an alarm pressure switch which is connected to the alarm line and is configured to trigger an alarm signal when there is a predetermined fluid pressure in the alarm line. The dry alarm valve station further comprises a first pressure-operated valve which is interposed between the alarm device and the alarm valve and is controlled by means of the control chamber and is configured to block the alarm line as long as the predetermined control pressure obtains in the control chamber and to open it when the pressure in the control chamber is below the predetermined control pressure. The invention makes use of the realization that, by the interposition of a pressure-operated valve and control of that pressure-operated valve by means of the same control chamber with which the alarm valve is also controlled, the alarm line is divided into a pressurized portion and a potentially relieved portion towards the alarm device. By virtue thereof it is possible for the alarm device to be kept pressure-less in the standby state, which facilitates maintenance and is advantageous in regard to the components of the alarm device. The necessary pressure threshold values can also be reduced, which permits a more rapid response characteristic. In addition this gives the advantage that the pressurized region which first has to be vented for an alarm alert to occur and which to some extent forms an "alarm chamber" involves a markedly smaller volume than in the state of the art as it is only defined by the portion of the alarm line between the alarm valve and the first pressure-operated valve. That also improves the response characteristic of the dry alarm valve station in terms of the alarm alert. In addition, by virtue of control by means of the pressure from the control chamber only a minimum apparatus involvement and complication is necessary, and no additional programming or control complexity for the first pressure-operated valve, and that contributes to simple installation and a compact structure.

An advantageous development provides that the dry alarm valve station has a fluid outlet and a second pressure-operated valve which is interposed between the control chamber and the fluid outlet, is controlled by means of the alarm line downstream of the first pressure-operated valve and is configured to relieve the control chamber when the first pressure-operated valve opens the alarm line. In accordance with this development the extinguishing fluid discharge is steadier and more reliable: after opening of the alarm valve extinguishing fluid passes into the outlet-side sprinkler line. As usually the control chamber of the dry alarm valve station is deluged by the fluid inlet side by way of a bypass there is the risk after opening of the alarm valve that the control chamber at least partially closes the alarm valve again by virtue of the incoming extinguishing fluid. In the state of the art ingenious dimensioning of the pressurized surfaces, control pistons, etc. of alarm valve and control chamber was required to prevent that from occurring. By implementation of the second pressurized valve the control chamber is connected to the outlet and thus relieved of pressure as soon as the second pressurized valve is actuated. That occurs by virtue of actuation on the downstream side of the alarm line from the first pressure-operated valve, immediately after the first pressure-operated valve has opened the alarm line. In other words, the control chamber is reliably kept open by the second pressure-operated valve as soon as the extinguishing operation is initiated. In this respect also the additional apparatus expenditure and control involvement is minimal.

In a preferred embodiment the first pressure-operated valve is in the form of a normally open valve (NO valve), preferably an NO diaphragm valve. Alternatively or additionally preferably the second pressure-operated valve is in the form of a normally closed valve (NC valve), preferably an NC diaphragm valve. Particularly preferably the second pressure-operated valve is in the form of an NC relief valve (PORV). In that case the fluid outlet is preferably provided directly at the second pressure-operated valve, which further optimizes structural design and installation involvement.

In a further preferred embodiment the dry alarm valve station is pilot-controlled. For that purpose the dry alarm valve station has a pilot control valve connected to a control chamber and configured to block or relieve the control chamber. In a first preferred alternative the pilot control valve is a pressure-operated valve which is controlled by means of the pressure occurring at the outlet side at the alarm valve and is configured to block the control chamber as long as there is a predetermined standby pressure at the outlet side at the alarm valve and to relieve the control chamber as soon as the pressure falls below the predetermined standby pressure. The expression pressure at the outlet side at the alarm valve is used to denote the pressure in the sprinkler line. The pilot control valve can be arranged directly at the dry alarm valve station, but also spaced from the dry alarm valve station, preferably in a near region of up to 2 m from the dry alarm valve station, spaced from the alarm valve. The standby pressure is that pressure on the outlet side of the alarm valve, therefore in the dry part of the fire extinguishing installation in the mounted state, which occurs in the standby state. The standby pressure is preferably in a region of less than 2 bars. Particularly preferably the pressure is in a region of 1 to 1.5 bars and is thus markedly lower than in the state of the art. The sprinkler network can be markedly greater developed because overall there is a smaller amount of air in the sprinkler line in the system, which has to escape at the beginning of an extinguishing situation.

The pilot control valve in this embodiment is preferably in the form of a diaphragm valve or a constant pressure valve. In particular the pilot control valve is in the form of a normally closed valve (NC valve).

In an alternative preferred embodiment the pilot control valve is a solenoid valve which can be in signal-conducting relationship to a fire alarm and/or extinguishing control center and is configured to relieve the control chamber in dependence on a trigger command from the fire alarm and/or extinguishing control center. In this embodiment actuation of the pilot control valve is no longer dependent on the pressure drop in the sprinkler line. With suitable actuation by the fire alarm and/or extinguishing control center that permits preliminary deluging of the sprinkler lines, even before they have triggered. A fire alarm and/or extinguishing control center is here connected as usual in signal-conducting relationship to one or more fire alarms which are configured to detect one or more respective fire characteristics and can therefore respond before a sprinkler is triggered.

In addition the use of a pilot control valve which is actuated by signaling technology is advantageous insofar as the sprinkler line downstream of the dry alarm valve station can be substantially pressure-less and this means that pressurized air does not have to be kept in the sprinkler line in the standby state because the pressure drop in the sprinkler line does not represent a control condition for the pilot control valve. That once more improves the response characteristic in respect of the dry alarm valve station.

The pilot control valve which is in the form of a solenoid valve is preferably also in the form of a normally closed valve (NC valve).

In a further preferred embodiment the pilot control valve which is a pressure-operated valve is a first pilot control valve and the dry alarm valve station additionally has a second pilot control valve which is a solenoid valve which can be connected in signal-conducting relationship to a fire alarm and/or extinguishing control center and is configured to relieve the control chamber in dependence on a trigger command from the fire alarm and/or extinguishing control center. Preferably the two pilot control valves are connected in series, wherein the second pilot control valve is preferably interposed upstream of the first pressure-operated pilot control valve. The pilot control redundancy implemented in that way means that triggering of the dry alarm valve station as a consequence of mere pressure fluctuations in the supply line is reduced as, besides the pressure drop in the sprinkler line, actuation by the fire alarm and/or extinguishing control center (for example after detection of a fire by a fire alarm) has to be effected in order to relieve the control chamber.

The second pilot control valve is preferably in the form of a normally closed valve (NC valve).

Alternatively preferably the second pilot control valve is in the form of a normally open valve (NO valve). In that case the second pilot control valve is kept closed for example by a continuously applied current or voltage signal. If a power failure or an unintentional interruption in the signal-conducting connection, for example due to a cable rupture, occurs, then with that configuration operation of the dry alarm valve station can still be effected by way of the pressure-operated pilot control valve.

In a further preferred embodiment the dry alarm valve station has a pressure measuring transducer which is operatively connected to the outlet side of the alarm valve and can be connected in signal-conducting relationship to the fire alarm and/or extinguishing control center. The pressure in the sprinkler line can be monitored by means of that pressure measuring transducer. Alternatively or additionally to the pressure measuring transducer it is also possible in advantageous embodiments to provide a pressure switch. Actuation of the pilot control valve or valves can be effected in such an embodiment in dependence on a pressure drop signaled by the pressure measuring transducer or pressure switch, in the sprinkler line, if the fire alarm and/or extinguishing control center is suitably configured.

In a further preferred embodiment the dry alarm valve station additionally has a third pilot control valve which is a solenoid valve which can be connected in signal-conducting relationship to a fire alarm and/or extinguishing control center and is configured to relieve the control chamber in dependence on a trigger command from the fire alarm center, wherein preferably the second pilot control valve is in the form of an NO valve and preferably the third pilot control valve is in the form of an NC valve. Preferably in this embodiment a pressure measuring transducer or pressure switch is operatively connected to the outlet side of the alarm valve and is configured, when the pressure falls below a predetermined pressure value, to output a signal to the fire alarm and/or extinguishing control center which thereupon actuates the third pilot control valve. This embodiment represents a synthesis of the above-indicated embodiments and affords the highest level of functional security of the embodiments discussed here.

The invention has been described hereinbefore with reference to a dry alarm valve station. In a further aspect the invention further concerns a fire extinguishing installation comprising a sprinkler line, one or more sprinklers arranged distributed on the sprinkler line, a supply line and a dry alarm valve station connecting the supply line to the sprinkler line. The object of the invention is attained in such a fire extinguishing installation in that the dry alarm valve station is in accordance with one of the above-described preferred embodiments.

A development of the invention in respect of the fire extinguishing installation provides that the dry alarm valve station has a pressure-operated pilot control valve which is controlled by means of the pressure at the outlet side at the alarm valve and is configured to block the control chamber as long as there is a predetermined operating pressure at the outlet side at the alarm valve and to relieve the control chamber as soon as the pressure falls below the predetermined standby pressure, wherein the fire extinguishing installation has at least one pilot control line and at least one pilot control sprinkler arranged at the pilot control line, wherein the pilot control valve is controlled by means of the pilot control line and is configured to block the control chamber as long as a predetermined standby pressure occurs in the pilot control line and to relieve the control chamber as soon as the pressure falls below the predetermined standby pressure. In this embodiment the fire extinguishing installation has a separate sprinkler system which is filled with pressurized air in the standby state and which is exclusively there to relieve the control chamber when a pressure drop is registered. This means that the sprinkler line which is connected to the supply line by way of the alarm valve can be kept pressure-less in the standby state.

In another development of the fire extinguishing installation according to the invention in which the dry alarm valve station is in accordance with one of those embodiments which have recourse to a pilot control valve in the form of a solenoid valve that fire extinguishing installation has a fire alarm and/or extinguishing control center.

Preferably moreover the fire extinguishing installation has at least one fire alarm connected in signal-conducting relationship to the fire alarm and/or extinguishing control center, wherein the pilot control valve in the form of a solenoid valve or at least one of the pilot control valves in the form of a solenoid valve, when using a plurality of pilot control valves, is connected in signal-conducting relationship to the fire alarm and/or extinguishing control center and the fire alarm and/or extinguishing control center is configured to control the pilot control valve or at least one of the pilot control valves in dependence on the alarm from at least one fire detector.

Preferably alternatively or additionally the dry alarm valve station has a pressure measuring transducer which is operatively connected to the outlet side of the alarm valve and is connected in signal-conducting relationship to the fire alarm and/or extinguishing control center, and the pressure measuring transducer is connected in signal-conducting relationship to the fire alarm and/or extinguishing control center, wherein the fire alarm and/or extinguishing control center is configured to control the pilot control valve or at least one of the pilot control valves in dependence on the pressure measurement values signaled from the pressure measuring transducer to the fire alarm and/or extinguishing control center.

In the fire extinguishing installations geared to the use of solenoid valves the alarm alert device, in particular the alarm pressure switch thereof, is preferably connected in signal-conducting relationship to the fire alarm and/or extinguishing control center. In that way a feedback signal can be generated in respect of triggering of the alarm device to the fire alarm and/or extinguishing control center as soon as the alarm line is deluged and the alarm alert device is actuated.

BRIEF DESCRIPTION OF THE DRAWINGS

The invention is described in greater detail hereinafter with reference to the accompanying Figures by means of preferred embodiments. In the drawings.

MODE(S) FOR CARRYING OUT THE INVENTION

Figure 1:
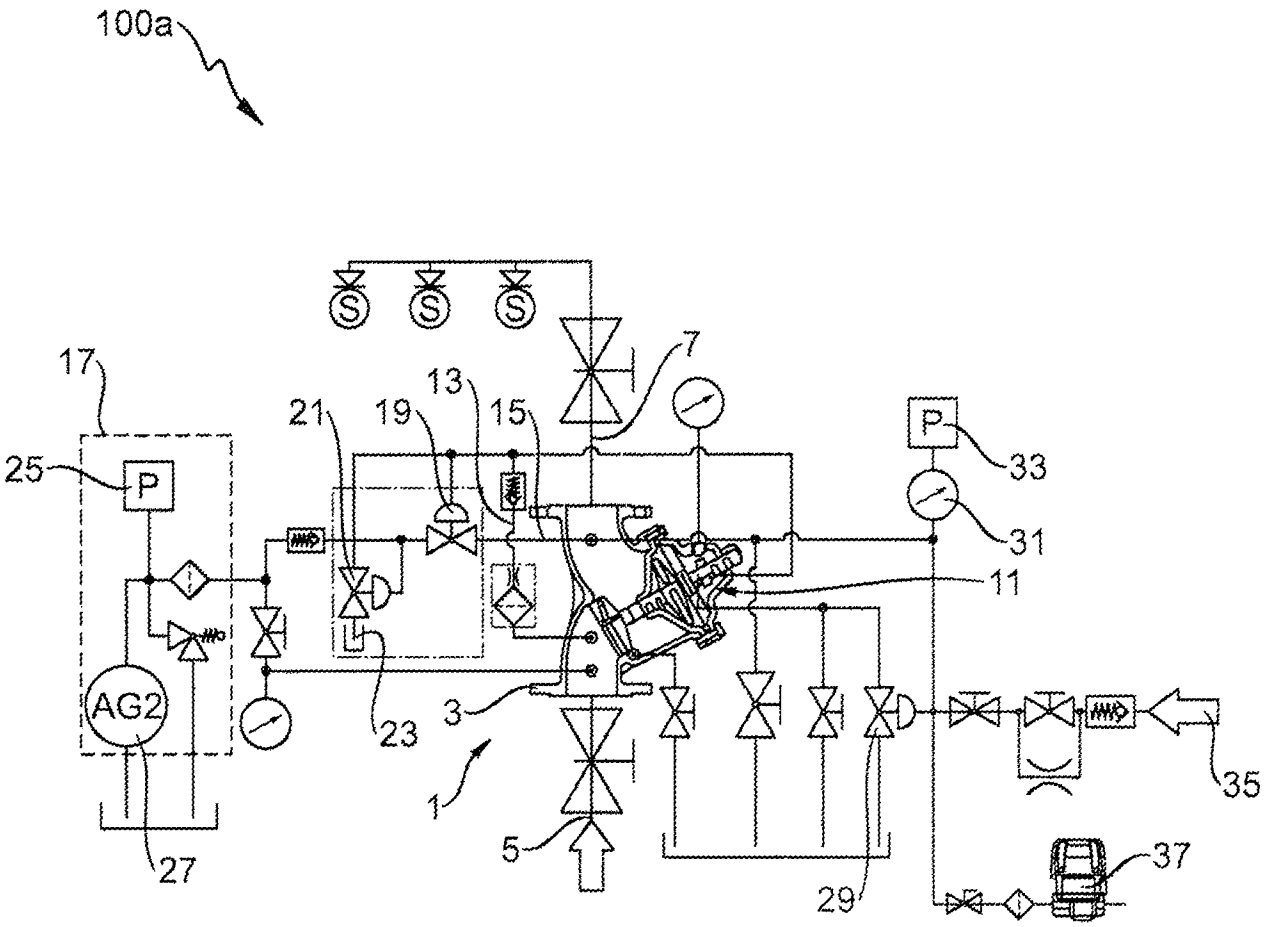
FIG. 1 shows a fire extinguishing installation having a dry alarm valve station according to a first embodiment.

FIG. 1 shows a fire extinguishing installation 100*a*. The fire extinguishing installation 100*a* has a dry alarm valve station 1 which includes an alarm valve 3 which is connected at the inlet side to a supply line 5 for an extinguishing fluid and at the outlet side to a sprinkler line 7 at which a plurality of sprinklers S are arranged in distributed fashion.

The alarm valve which in the present embodiment is in the form of a spray deluge valve has a control chamber 11 in which a diaphragm-actuated control plunger is arranged, which controls a valve body 9 of the alarm valve 3 by pressure actuation. The control chamber 11 is pressurized from the inlet side of the alarm valve 3 by means of a bypass line 13 which optionally has a dirt trap and/or a throttle and/or a flap check valve in order to present the bypass state shown in FIG. 1 with the valve body closed. In this standby state the valve body 9 blocks the alarm valve 3 to prevent fluid from passing therethrough from the inlet side to the outlet side.

The dry alarm valve station 1 has an alarm line 15 extending from the alarm valve 3 to an alarm alert device 17. The alarm alert device 17 has an alarm pressure switch 25 and a hydraulic alarm bell 27. The alarm alert device 17 is configured to be actuated when the alarm line 15 is deluged by opening of the valve body 9. Interposed between the alarm valve 3 and the alarm alert device 17 is a (first) pressure-operated valve 19 actuated by means of the pressure in the control chamber 11. The pressure-operated valve 19 is a normally open diaphragm valve.

If there is a predetermined fluid pressure in the control chamber 11, corresponding to the standby state, the (first) pressure-operated valve 19 is held in the closed state. In this state the part of the alarm line 15 between the alarm valve 3 and the alarm alert device 17 is blocked. The pressure in the sprinkler line 7 is thus closed off. The downstream part of the alarm line 15 towards the alarm alert device 17 is preferably pressure-less.

In addition to the (first) pressure-operated valve 19 the dry alarm valve station has a second pressure-operated valve 21, preferably a pressure-operated relief valve (PORV), which is in the form of a normally closed valve and at the outlet side has a relief opening 23 representing a fluid discharge of the dry alarm valve station 1.

The second pressure-operated valve 21 is actuated by means of the pressure in the alarm line 15 downstream of the first pressure-operated valve 19 and opens as soon as the alarm line 15 is deluged after opening of the first pressure-operated valve. The second pressure-operated valve 21 is connected at the inlet side to the control chamber 11 of the alarm valve 3 and is configured to relieve same in the opened state so that closing of the valve body 9 as a result of a pressure build-up in the control chamber 11 after triggering of the extinguishing process is reliably prevented.

The alarm valve 3 is pilot-controlled by means of a pilot control valve 29. The pilot control valve 29 is preferably a pressure-operated normally open valve configured in the open state to relieve the control chamber 11 and in the closed state to block same, wherein the pilot control valve 29 is actuated by means of the pressure at the outlet side at the alarm valve 3. Preferably a pressure in the sprinkler line 7 should be in a region between 0.5 and 2 bars so that the pilot control valve 29 is reliably held in the closed state. When a pressure drop is produced in the sprinkler line 7, for example by opening of one or more sprinklers, the pilot control valve 29 opens so that relief of the control chamber 11 begins and the valve body 9 can open the alarm valve 3. In that state then the first pressure-operated valve 19 is also opened whereby the alarm line 15 is deluged and then alarm alert is effected by the alarm alert device 17, wherein the second pressure-operated valve 21 prevents unintentional closing of the valve body 9 in the alarm valve 3.

Optionally provided at the outlet side at the alarm valve 3 is a pressure measuring transducer 31 and/or a further pressure switch 33 to be able to monitor the pressure profile in the sprinkler line 7.

The sprinkler line, the alarm line 15 and the corresponding control lines are preferably supplied by means of a compressed air feed 35.

Optionally the fire extinguishing installation 100*a* has a venting accelerator 37 which when a predetermined pressure drop is registered within the sprinkler 7, opens a line cross-section to achieve accelerated venting.

Insofar as the same reference numerals have been used in following FIGS. 2 through 6 as in FIG. 1 they denote functionally or structurally identical features. In regard to those features and the mode of operation thereof attention is directed to the foregoing description relating to FIG. 1.

Figure 2:
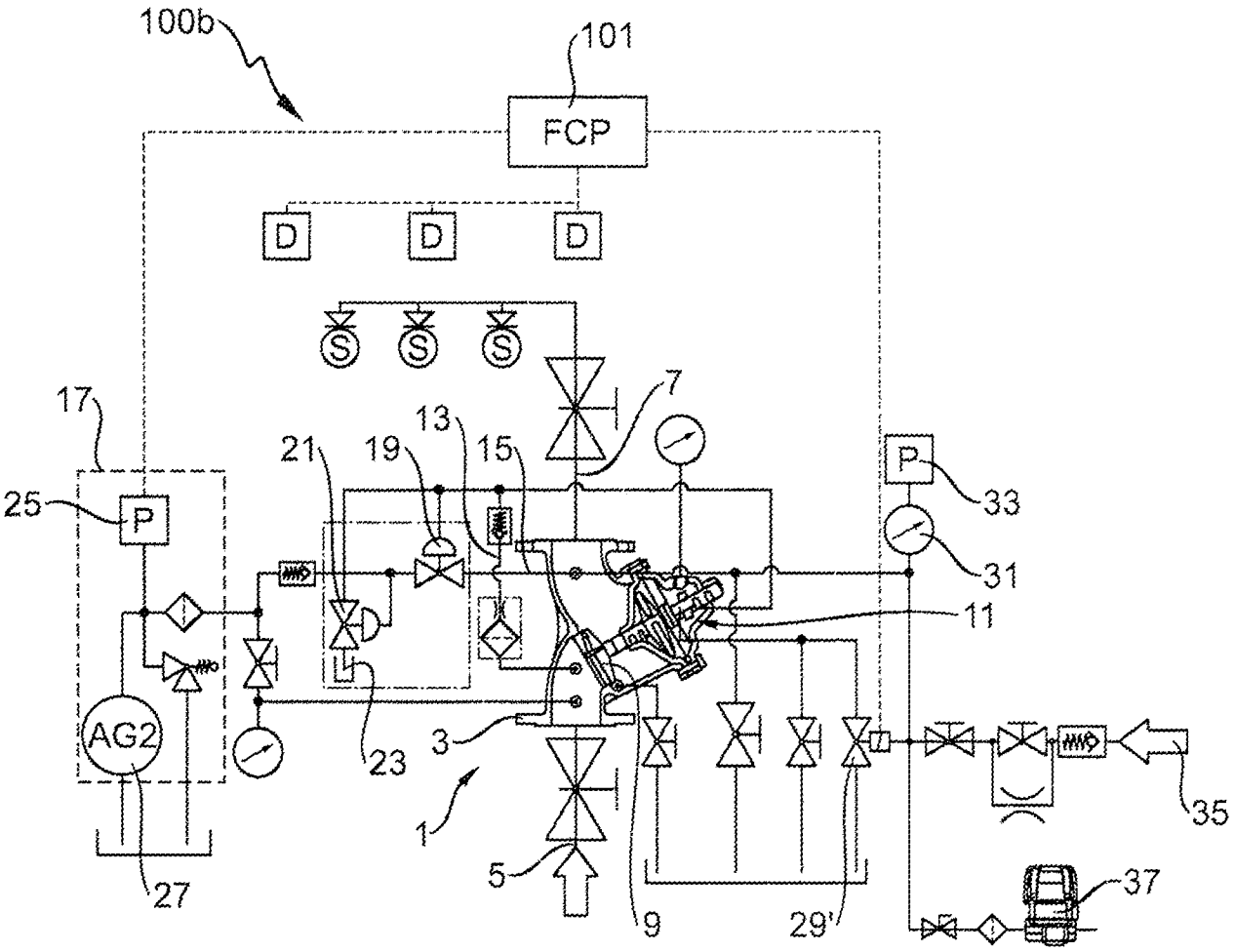
FIG. 2 shows a fire extinguishing installation having a dry alarm valve station according to a second embodiment.

The fire extinguishing installation 100*b* shown in FIG. 2 is functionally identical in essential aspects to the fire extinguishing installation 100*a* shown in FIG. 1. Unlike the fire extinguishing installation 100*a* of FIG. 1 the fire extinguishing installation 100*b* has an electrically pilot-controlled dry alarm valve station 1 in which there is provided a pilot control valve 29' which is in the form of a solenoid valve and which is a normally closed valve. The pilot control valve 29' is connected in signal-conducting relationship to a fire alarm and/or extinguishing control center 101 which in turn is connected in signal-conducting relationship to a number of fire alarms D, the fire alarms D being configured to detect one or more fire characteristics. Functionally the fire extinguishing installation 100*b* and its dry alarm valve station 1 differ from the system shown in FIG. 1 insofar as triggering of actuation of the alarm valve 3 does not have to be effected by the opening of one or more sprinklers S, but upon detection of a fire characteristic by one or more of the sprinklers D pre-deluging of the sprinkler line 7 can already be effected if the fire alarm and/or extinguishing control center 101 sends a corresponding control command to the pilot control valve 29'. The sprinkler line 7 in the fire extinguishing installation 100*b* can be kept pressure-less in its standby state. It is only if it is desired to track the pressure profile in the sprinkler line 7 or to use it as a control parameter by means of the pressure measuring transducer 31 and/or the pressure switch 33 that a certain pressurization of the sprinkler line 7 should be effected, for example in a region of 0.5-1 bar. The less air that there is in the sprinkler line 7 venting is correspondingly faster in the application situation.

Figure 3:
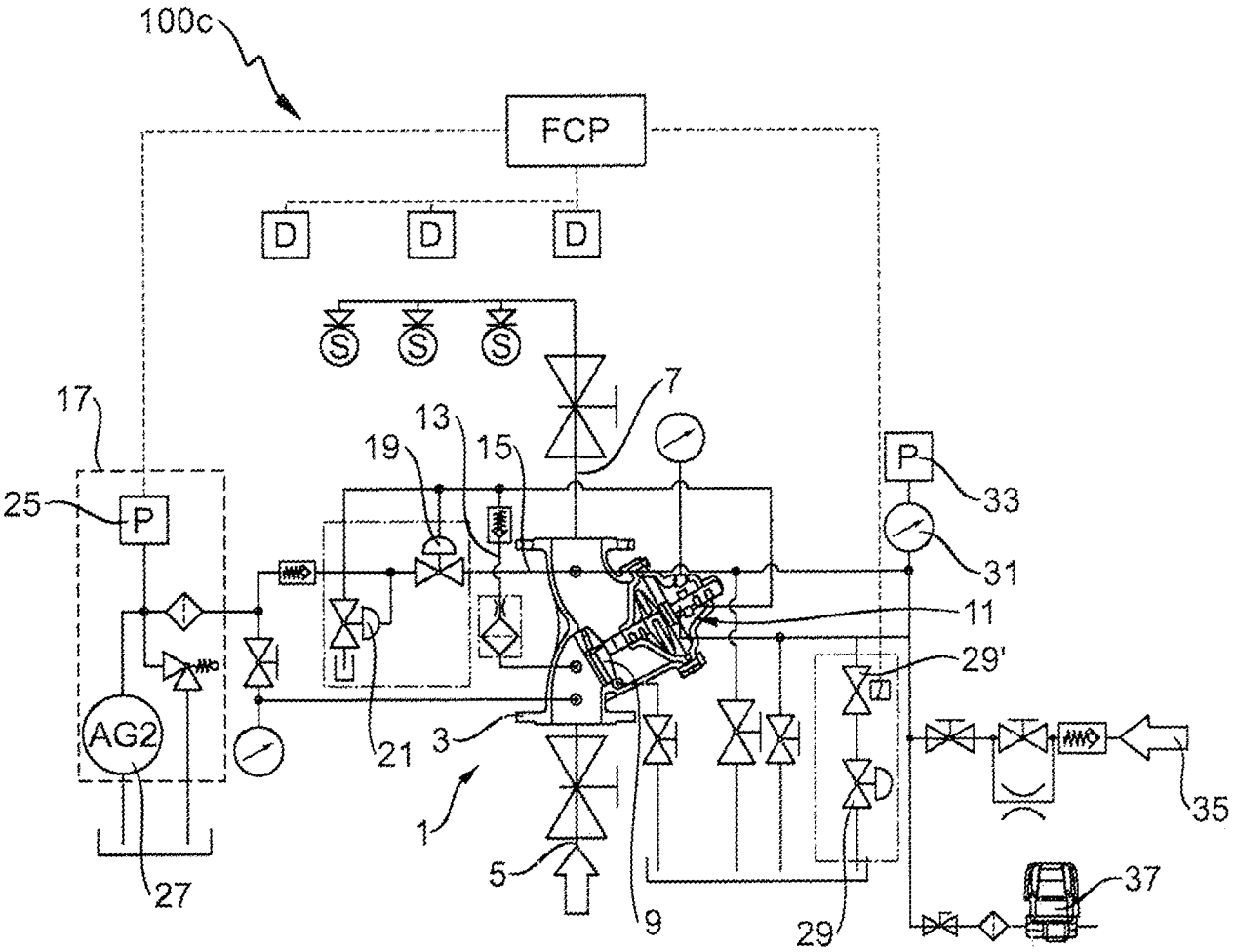
FIG. 3 shows a fire extinguishing installation having a dry alarm valve station according to a further embodiment.

FIG. 3 shows a further modification of the dry alarm valve station 1 in a fire extinguishing installation 100*c*. The fire extinguishing installation 100*c* differs from the fire extinguishing installations 100*a*, 100*b* in that to a certain extent as a synthesis of the two fire extinguishing installations 100*a, b* it has both a first pilot control valve 29 and also the second pilot control valve 29' of FIG. 2. The first and second pilot control valves 29, 29' are connected in series so that redundant actuation of both pilot control valves 29, 29' has to be effected to relieve the control chamber 11.

In this case the second pilot control valve 29' can either be in the form of a normally closed valve, as in FIG. 2, or a normally open valve. In the latter case actuation of the alarm valve by the pilot control valve 29 is effected even when alarm alerting by the fire alarm and/or extinguishing control center 101 does not occur or the signal-conducting connection between the second pilot control valve 29' and the fire alarm and/or extinguishing control center 101 is disrupted.

Figure 4:
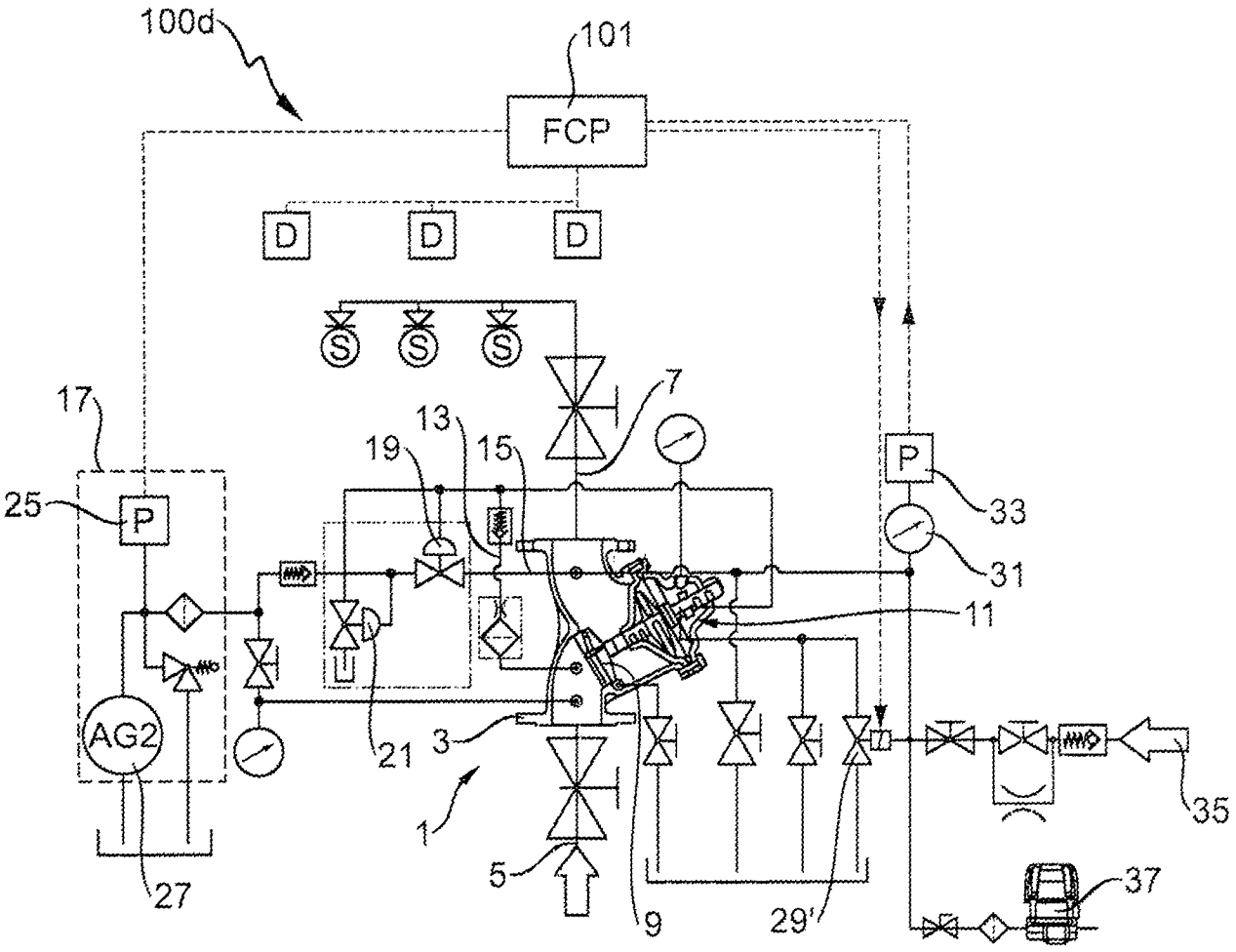
FIG. 4 shows a fire extinguishing installation having a dry alarm valve station according to a further embodiment.

FIG. 4 shows a fire extinguishing installation 100*d* based on the fire extinguishing installation 100*b*. Unlike the fire extinguishing installation 100*b* actuation of the pilot control valve 29' is effected either alternatively, additionally or redundantly as soon as the pressure switch 33 registers a pressure drop in the sprinkler line 7 and has communicated a corresponding signal to the fire alarm and/or extinguishing control center 101. That is indicated by the directional arrows in the signal lines between the fire alarm and/or extinguishing control center 101, the pilot control valve 29' and the pressure switch 33.

Figure 5:
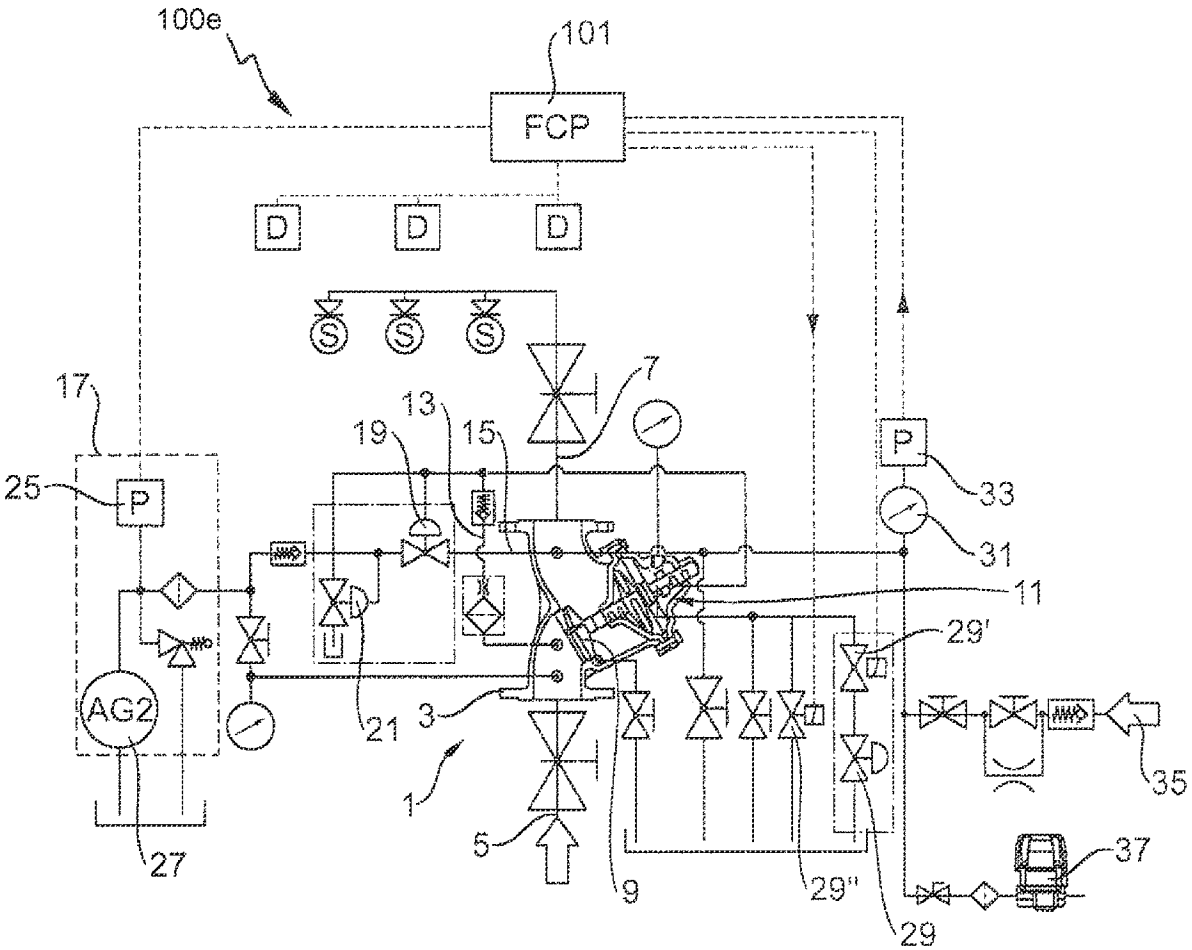
FIG. 5 shows a fire extinguishing installation having a dry alarm valve station according to a further embodiment.

FIG. 5 then shows a fire extinguishing installation 100*e* according to a further embodiment which to a certain extent represents a synthesis between the fire extinguishing installations 100*c* and 100*d* shown in FIGS. 3 and 4. The dry alarm valve station 1 installed here, besides the first and second pilot control valves 29, 29', additionally includes a third pilot control valve 29" which is in the form of a normally closed solenoid valve and is connected in parallel with the first and second pilot control valves 29, 29'.

In the embodiments of FIGS. 2 through 5 the respective alarm pressure switch 25 of the alarm alert device 17 is connected in signal-conducting relationship to the fire alarm and/or fire extinguishing center 101 in order to be able to send a corresponding signal thereto in an alarm situation.

Figure 6:
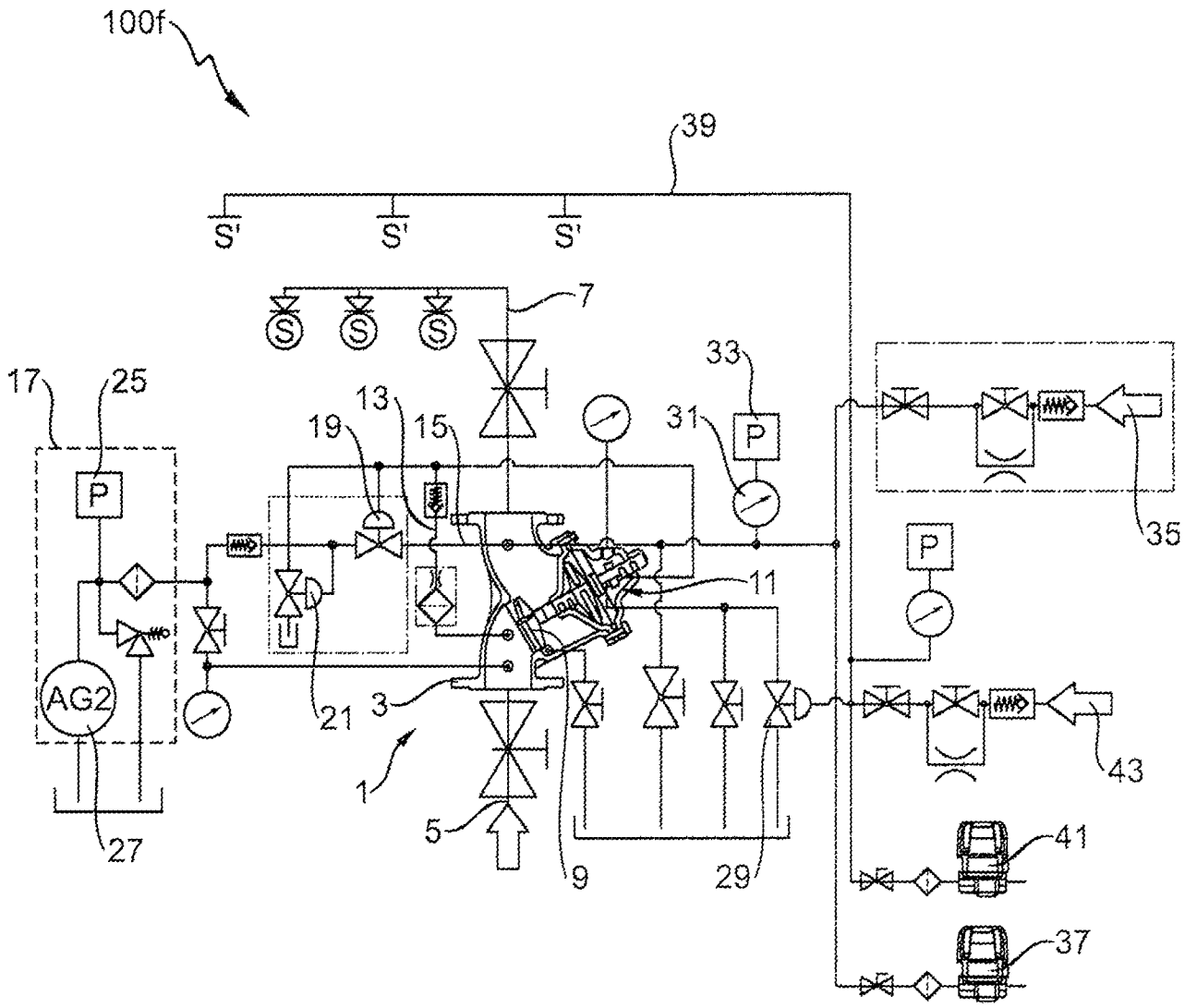
FIG. 6 shows a fire extinguishing installation having a dry alarm valve station according to a further embodiment.

FIG. 6 finally shows a fire extinguishing installation 100*f* in which the dry alarm valve station 101, similar to the embodiment of FIG. 1, is pilot-controlled purely pneumatically by means of a pilot control valve 29. It will be noted however that the fire extinguishing installation 100*f* has a separate pilot control line 39 at which a number of pilot control sprinklers S' are arranged in distributed relationship.

The pilot control line 39 is preferably to be put under pressure by means of a dedicated compressed air supply 43. The pilot control valve 29 is actuated by means of the pilot control line 39 and is configured to relieve the control chamber 11 as soon as the pilot control sprinklers S' and not the regular sprinklers S in the sprinkler line 7 are triggered. Further preferably the pilot control line 29 also has a connection with a venting accelerator 41 which in the trigger situation of one or more sprinklers S' brings about accelerated venting of the pilot control line 39.

In all illustrated embodiments which use a pressure-operated valve 29 as the pilot control valve it would be possible for example to use a diaphragm valve or a constant pressure valve, in which respect the constant pressure valve affords particular advantages in regard to a control pressure which is necessary in the standby state.

LIST OF UTILIZED REFERENCE NUMBERS

1 dry alarm valve station
3 alarm valve
5 supply line
7 sprinkler line
9 valve body
11 control chamber
13 bypass
15 alarm line
17 alarm alert device
19 first pressure-operated valve
21 second pressure-operated valve
23 fluid discharge
25 alarm pressure switch, alarm alert device
27 hydraulic alarm bell
29 pilot control valve, first
29' pilot control valve, second
29" pilot control valve, third
31 pressure measuring transducer
33 pressure switch (sprinkler line)
35 compressed air feed
37 venting accelerator
39 pilot control line
41 venting accelerator, pilot control line
43 compressed air feed, pilot control line
100*a-f* fire extinguishing installation
101 fire alarm and/or fire extinguishing center
D fire alarm
S sprinkler
S' pilot control sprinkler

The invention claimed is:

1. A dry alarm valve station of a fire extinguishing installation comprising:

an alarm valve which is configured to be connected at an inlet side thereof to an extinguishing fluid-filled supply line and at an outlet side thereof to a sprinkler line which is air-filled in a standby state of the fire extinguishing installation and comprises a pressure-operated valve body which is controlled by a control chamber and which is configured to separate the supply line from the sprinkler line in a blocking state as long as there is a predetermined control pressure in the control chamber, and to connect the supply line to the sprinkler line when in a release state, an alarm line connected to the alarm valve in such a way that the alarm line is deluged with extinguishing fluid when the alarm valve assumes the release state, an alarm device, the alarm device being connected to the alarm line and configured to trigger an alarm signal when there is a predetermined fluid pressure in the alarm line, and a first pressure-operated valve which is interposed between the alarm device and the alarm valve and is controlled by the control chamber and is configured to block the alarm line as long as the predetermined control pressure is maintained in the control chamber and to open the alarm line when the pressure in the control chamber is below the predetermined control pressure.

2. A dry alarm valve station as set forth in claim 1, further comprising:

a fluid outlet and a second pressure-operated valve which is interposed between the control chamber and the fluid outlet, wherein the second pressure-operated valve is controlled by the alarm line downstream of the first pressure-operated valve and is configured to relieve the control chamber when the first pressure-operated valve opens the alarm line.

3. A dry alarm valve station as set forth in claim 1, wherein the first pressure-operated valve is in the form of a normally open valve.

4. A dry alarm valve station as set forth in claim 2, wherein the second pressure-operated valve is in the form of a normally closed valve.

5. A dry alarm valve station as set forth in claim 1, further comprising:

a pilot control valve which is connected to the control chamber and is configured to block or relieve the control chamber.

6. A dry alarm valve station as set forth in claim 5, wherein the pilot control valve is a pressure-operated valve which is controlled by a pressure occurring at the outlet side of the alarm valve and is configured to block the control chamber as long as there is a predetermined standby pressure at the outlet side of the alarm valve and to relieve the control chamber as soon as the pressure falls below the predetermined standby pressure.

7. A dry alarm valve station as set forth in claim 6, wherein the pilot control valve is a diaphragm valve or a constant pressure valve.

8. A dry alarm valve station as set forth in claim 5, wherein the pilot control valve is a solenoid valve which is configured to be in signal communication with a fire alarm and/or an extinguishing control center and is configured to relieve the control chamber as a function of a trigger command from the fire alarm and/or the extinguishing control center.

9. A dry alarm valve station as set forth in claim 8, wherein the pilot control valve is a normally closed valve.

10. A dry alarm valve station as set forth in claim 5, wherein the pilot control valve is a first pilot control valve and the dry alarm valve station includes a second pilot control valve which is a solenoid valve which is configured to be in signal communication with a fire alarm and/or an extinguishing control center and is configured to relieve the control chamber as a function of a trigger command from the fire alarm and/or the extinguishing control center.

11. A dry alarm valve station as set forth in claim 10, wherein the second pilot control valve is a normally closed valve.

12. A dry alarm valve station as set forth in claim 10, wherein the second pilot control valve is a normally open valve.

13. A dry alarm valve station as set forth in claim 8, further comprising:

a pressure transducer which is operatively coupled to the outlet side of the alarm valve and configured to be in signal communication with the fire alarm and/or the extinguishing control center.

14. A dry alarm valve station as set forth in claim 10, wherein the dry alarm valve station includes a third pilot control valve which is a solenoid valve which is configured to be in signal communication with the fire alarm and/or the extinguishing control center and is configured to relieve the control chamber as a function of a trigger command from the fire alarm and/or the extinguishing control center, wherein the second pilot control valve is a normally open valve and the third pilot control valve is a normally closed valve.

15. A fire extinguishing installation comprising:

a sprinkler line, one or more sprinklers distributed along the sprinkler line, a supply line, and a dry alarm valve station connecting the supply line to the sprinkler line, wherein the dry alarm valve station is as set forth in claim 1.

16. A fire extinguishing installation comprising:

a sprinkler line, one or more sprinklers distributed along the sprinkler line, a supply line, and a dry alarm valve station connecting the supply line to the sprinkler line, wherein the dry alarm valve station comprises the dry alarm valve station as set forth in claim 6 with at least one pilot control line and at least one pilot control sprinkler arranged at the pilot control line, wherein the pilot control valve is controlled by the pilot control line and is configured to block the control chamber as long as a predetermined standby pressure occurs in the pilot control line and to relieve the control chamber as soon as the pressure falls below the predetermined standby pressure.

17. A fire extinguishing installation comprising:

a sprinkler line, one or more sprinklers distributed along the sprinkler line, a supply line, and a dry alarm valve station connecting the supply line to the sprinkler line, wherein the dry alarm valve station comprises the dry alarm valve station as set forth in claim 14, and a fire alarm and/or an extinguishing control center.

18. A fire extinguishing installation as set forth in claim 17, comprising:

at least one fire alarm in signal communication with the fire alarm and/or the extinguishing control center, wherein the solenoid valve of the second pilot control valve or at least one of the solenoid valves of the second and third pilot control valves is a solenoid valve and is in signal communication with the fire alarm and/or the extinguishing control center and the fire alarm and/or the extinguishing control center is configured to control the second pilot control valve or at least one of the second and third pilot control valves in dependence on an alarm from the at least one fire alarm.

19. A fire extinguishing installation as set forth in claim 18, wherein the dry alarm valve station includes a pressure measuring transducer is in signal communication with the fire alarm and/or the extinguishing control center, wherein the fire alarm and/or the extinguishing control center is configured to control the second pilot control valve or at least one of the second or third pilot control valves as a function of pressure measurement values signaled from the pressure measuring transducer to the fire alarm and/or the extinguishing control center.

20. A fire extinguishing installation as set forth in one claim 17, wherein the alarm device includes an alarm pressure switch is connected in signal-conducting relationship to the fire alarm and/or the extinguishing control center.

* * * * *